United States Patent [19]

Wu

[11] Patent Number: 4,958,746

[45] Date of Patent: Sep. 25, 1990

[54] TOOTH-PICK DISPENSER

[76] Inventor: Ching K. Wu, Room 2, 11F, Shoei-Yuan Road, Taipei, Taiwan

[21] Appl. No.: 394,477

[22] Filed: Aug. 16, 1989

[51] Int. Cl.[5] ..... A24F 15/04; G07F 11/00

[52] U.S. Cl. ..... 221/24; 221/234; 221/238; 221/210

[58] Field of Search ..... 221/24, 234, 238, 210, 221/266

[56] References Cited

U.S. PATENT DOCUMENTS

| | | | |
|---|---|---|---|
| 1,887,389 | 11/1932 | Adams | 221/238 X |
| 2,006,982 | 7/1935 | Aronson | 221/234 |
| 2,357,818 | 9/1944 | Furr | 221/234 |
| 2,373,476 | 4/1945 | King | 221/234 |
| 2,562,666 | 7/1951 | Gustafson et al. | 221/234 |
| 2,954,143 | 9/1960 | Adams | 221/234 X |

*Primary Examiner*—Andres Kashnikow
*Assistant Examiner*—Kenneth DeRosa
*Attorney, Agent, or Firm*—Bacon & Thomas

[57] ABSTRACT

A tooth-pick dispenser includes a housing a perforated top and a vertical side wall having an opening, a tooth-pick pickup device simulating a seagull and for oscillating movement supported on a top of the housing for supplying a tooth-pick, a drawer reciprocable in the opening of the vertical side wall of the housing between a toothpick receiving position in the housing and a tooth-pick delivery position exterior of the housing, and having a reciprocable body for catching a tooth-pick in the delivery position and conveying it to the delivery position and a link mechanism interconnecting the pickup device and the drawer, whereby the pickup device can be swung to a pickup position so as to operate the link mechanism to move the drawer to its delivery position, and the drawer will be automatically retracked a spring to operate the link mechanism to swing the pickup device back to a raised dispensing position for serving a tooth-pick to a user in a convenient position.

1 Claim, 3 Drawing Sheets

TOOTH-PICK DISPENSER

BACKGROUND OF THE INVENTION

This invention relates to a tooth-pick dispensing device.

A variety of cigarette dispensing devices is disclosed in, for example, U.S. Pat. Nos. 2,373,476, 2,562,666 and 2,954,143. The constructionns of the embodiments disclosed by said patents with a cigarette receptacle and a pick-up structure simulating a bird being spacedly mounted on a box-like base and relatively large in size.

SUMMARY OF THE INVENTION

Accordingly, it is an object of the present invention to provide a tooth-pick dispenser which is compact in construction and elegant in appearance and suitable for locating on a dining table.

It is another object of the present invention to provide a tooth-pick dispenser which dispenses a single tooth-pick at a time and serves the so dispensed tooth-pick to a user in a convenient position.

It is a further object of the present invention to provide tooth-pick at a time and serves the so dispensed tooth-pick to a user in a convenient position.

It is a further object of the present invention to provide a tooth-pick dispenser of this nature which is sturdy and durable in construction, reliable and efficient in operation, and relatively simple and inexpensive to manufacture and assemble.

The above and further objects, features and advantages of the present invention will become more obvious from the following description of a preferred embodiment thereof, taken in conjunction with the drawings.

DETAILED DESCRIPTION OF THE PREFERRED EMBODIMENT

Figure 1:
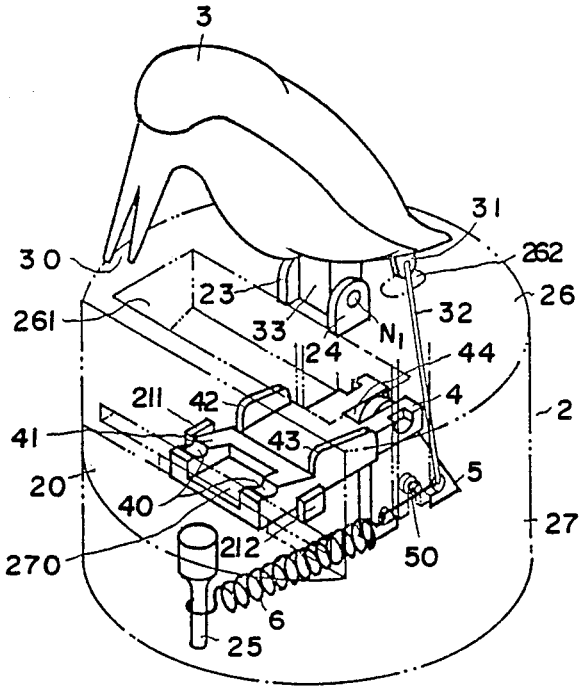
FIG. 1 is a perspective view of a preferred embodiment of tooth-pick dispenser of this invention wherein a housing is shown in dotted line.

A tooth-pick dispenser according to the present invention mainly comprises a cylindrical housing 2 having an upper cut-off portion 20, a pickup device 3 of a simulated figure pivotally mounted on the housing 2 and a drawer member 4 substantially horizontally movably fitted in the housing 2.

The housing 2 includes a top 26 having a rectangular filling opening 261 close to the cut-off portion and adapted to feed tooth-picks into a tooth-pick chamber 21 which is to be explained later, a side wall structure 27 having a vertical side wall 271 and a horizontal side wall 272 in the cut-off portion 20 with a rectangular opening 270 spaced from the top transversely formed in the vertical side wall 271, and a bottom 8.

A pair of spaced journal members 23, 24 and carried by the top plate 26 and an opening 262 opposed to the filling opening 261 is formed in the top plate 26.

The pickup device 3 has a structure simulating the appearance of a seagull having a head portion provided with a beak 30 open to diverge outwardly from the head portion and so spaced at the outer end as to receive and frictionally hold a tooth-pick 1, an arm 33 integrally extending downwardly from a flank portion and a journal member 31 intergrally extending downwardly from a tail portion thereof.

Figure 2:
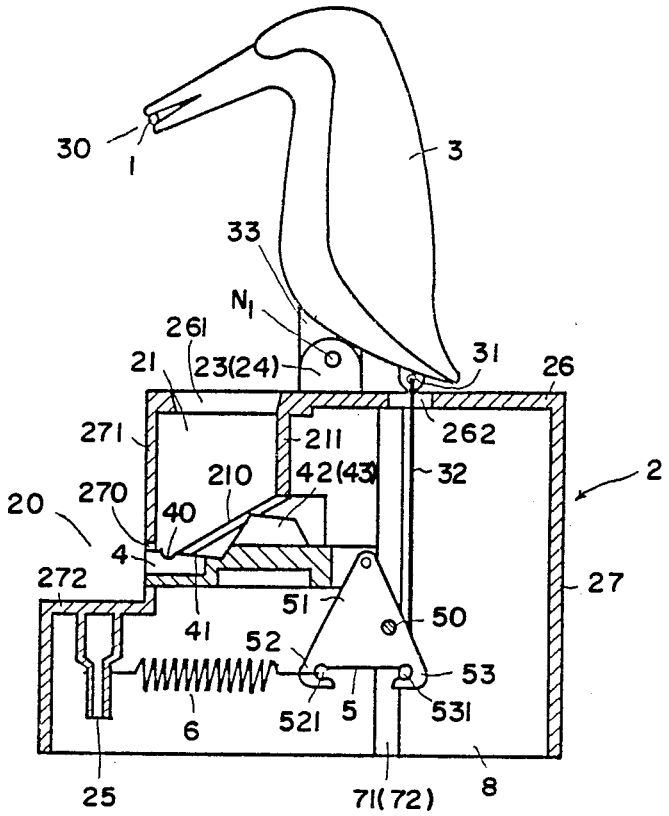
FIG. 2 is a cross-sectional view of the tooth-pick dispenser showing the pickup device in the dispensing position and the drawer fully retracted to the receiving position.
Figure 3:
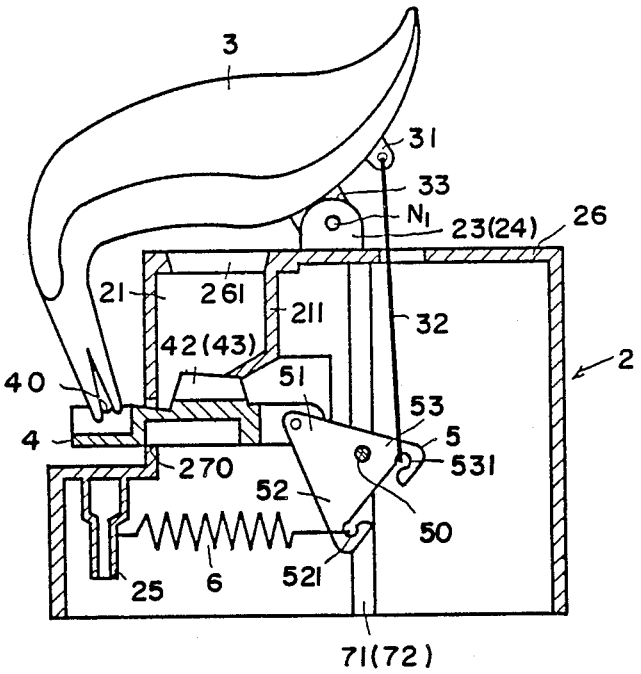
FIG. 3 is a cross-sectional view of the tooth-pick dispenser showing the pickup device in the pickup position and the drawer in the delivery position.

For supporting the pickup device 3 for oscillating movement on the top plate 26 of the housing 2, the arm 33 is pivoted to the journal members 23, 24 by means of a pin N1. The device 3 can be manually oscillated between a lower pickup position, as shown in FIG. 3, and a raised dispensing position, as shown in FIGS. 1 & 2.

A tooth-pick chamber 21 close to the cut-off portion 20 is provided in the housing 2 and defined mainly by the frontward top plate 26 having the filling opening 261, the vertical side wall 271, a partition plate 211 spaced from the vertical side wall 271 and extending downwardly from a bottom of the top plate 26, and an inclined floor-like member 210 which slopes downwardly from the lower end of the partition plate 211 to the rectangular opening 270 of the vertical side wall 271. The front end of the inclined member 210 is spaced from the vertical side wall 271, thus providing a passage for the discharge, one at a time, downwardly of tooth-pick 1 adapted to be supported by the inclined member 210.

The drawer member 4 reciprocates horizontally in the rectangular opening 270 in the vertical side wall 271, its cross sectional dimensions being such that it will close said opening 270, and its frontward upper side being substantially in the horizontal plane of the top end of the rectangular opening 270.

The drawer member 4 includes a body 41 elongated horizontally and a pair of opposed guiders 211, 212 extending upwardly from the bottom 8 of the housing 2 and preferably abutting the lateral sides of the body 41 for guiding the reciprocating movement of the body 41 through the rectangular opening 270. The upper side of the body 41 of the drawer member 4 adjacent to its front end is provided with a transverse channed 40, so disposed that, when the body 41 is in its rearmost tooth-pick receiving position, as shown in FIG. 2, the transverse channel 40 will be just below and in vertical alignment with the discharge passage between the vertical side wall and the inclined floor-like member 210, whereby when a tooth-pick is discharged downwardly through the passage, it will fall and rest longitudinally in the transverse channel 40. A slot 44 is cut from the rear end of the body 41 along its longitudinal direction.

A substantially angular plate 5 has a transverse supporting rod 50 in its center portion with the two ends of the rod 50 being respectively pivoted in two opposed supporting posts 71, 72 extending vertically between the top plate 26 and the bottom 8 of the housing 2 beside the body 41. The angular plate 5 has a top corner portion 51 and two base corner portions 52, 53, wherein the top corner portion 51 is pivoted in the slot 44 of the body 41 and the two base corner portions 52, 53 has respective grooves 521, 531 formed therein. A coil spring 6 is mounted in the housing 2 with its rear end connected to the base corner portion 52 of the angular plate 5 through the groove 521 and its front end suitably connected to a pin 25 extending downwardly from a bottom of the horizontal side wall 272.

A link 32 interconnects the pickup device 3 and the angular plate 5 with its upper end pivoted to the journal member 31 of the pickup device 3 and its lower end pivoted to the base corner portion 53 of the angular plate 5 through the groove 531 thereof.

When the pickup device 3 is manually swung counterclockwise from its raised dispensing position to its lower pickup position, the angular plate 5 will turn counterclockwise about the rod 50 so as to protrude forward the body 41 of the drawer member 4 from its rearmost receiving position in the housing 2 to a delivery position where the transverse channel 40 with a tooth-pick longitudinally rested therein is exposed out of the housing 2, as shown in FIG. 3 and the tooth-pick 1 will be forced into the open beak 31 and firmly held in the transverse position by the beak 30.

A pair of opposed projectors 42, 43 up-raised from a mid portion of the body 41 of the drawer member 4 are provided for pushing the stacking tooth-picks toward and against a back side of the vertical side wall 271 as the body 41 is moved outwardly and forwardly to its exterior delivery position so as to secure downward discharge of one tooth-pick into the transverse channel 40 as the body 41 is automatically retracked to its receiving position by means of the coil spring 6.

Many modifications of this invention, within the scope of the appended claim, may be made without departing from the spirit of this invention.

What is claimed is:

1. A tooth-pick dispenser comprising a substantially cylindrical housing having a perforated top and a cut-off portion defined by a vertical side wall extending downwardly from the top and a horizontal side wall parallel to the top;

a tooth-pick filling opening formed in the top of the housing close to the cut-off portion and adapted to fill tooth-picks into the housing;

an opening formed in the vertical side wall and spaced from the top of the housing;

a tooth-pick chamber in the housing having means for suporting tooth-picks and for delivering them downwardly one at a time;

a drawer member disposed in the opening of the vertical side wall for reciprocation between a tooth-pick receiving position in the housing and a tooth-pick delivery position exterior of the housing and having a slot cut longitudinally from a rear end thereof and means for catching a tooth-pick delivered from the chamber in the housing and conveying it to the delivery position;

at least a projector extending upwardly from a mid portion of the drawer member for pushing tooth-picks stacked in the chamber toward the vertical side wall when the drawer member moves from the receiving position to the delivery position;

guide means abutting lateral sides of the drawer member for guiding the reciprocating movement of the drawer member;

a pick up device having a structure simulating the appearance of a seagull having a supporting member extending downwardly from a flank portion thereof, a head portion spaced from the supporting member and provided with a tooth-pick pickup means extending forwardly outwardly and having an opening diverging outwardly from the head portion and a tail portion opposite to the head portion;

means for pivotally supporting the pickup device on the top of the housing whereby the seagull pickup device may be manually osciallated between a lower pickup position and a raised dispensing position; an angular member having three corner portions, and rotatably mounted on a supporter in the housing;

means for pivotally supporting a first corner portion of the angular member to the rear end of the drawer member in the slot thereof;

a link pivotally interconnecting the tail portion of the seagull pickup device and a second corner portion of the angular member so as to effect synchronized movement thereof upon actuation of said seagull pickup device;

a spring member with two ends pivotally interconnecting a third corner portion of the angular member and an arm extending downwardly from the horizontal side wall of the housing; and whereby, when said seagull pickup device is swung to the pickup position, said link and angular member will operate to move said drawer member to the exterior delivery position and the projector on the drawer member will push the tooth-picks stacked in the chamber to move toward the vertical side wall of the housing, and when said seagull pickup device is released, said link and angular member will be operated by the spring member to fully retract said drawer member to its inner receiving position and swing the seagull pickup device to its raised dispensing position.

* * * * *